US006091010A

United States Patent [19]

Gauger

[11] Patent Number: 6,091,010

[45] Date of Patent: Jul. 18, 2000

[54] CAMBER INDUCED SNARE ADJUSTER

[76] Inventor: Gary L. Gauger, 15108 Highland La., Minnetonka, Minn. 55345

[21] Appl. No.: 08/997,581

[22] Filed: Dec. 23, 1997

[51] Int. Cl.[7] ..... G10D 13/02

[52] U.S. Cl. ..... 84/415; 84/416; 84/417

[58] Field of Search ..... 84/415, 416, 417, 84/411 R, 421

[56] References Cited

U.S. PATENT DOCUMENTS

| | | | |
|---|---|---|---|
| 375,491 | 12/1887 | Ivers | 84/209 |
| 889,331 | 6/1908 | Platz, Jr. | 84/411 R |
| 1,236,667 | 8/1917 | Bower | 84/415 |
| 2,604,001 | 7/1952 | Lewan | 84/417 |
| 3,113,481 | 12/1963 | Thompson | 84/415 |
| 4,018,130 | 4/1977 | Gariepy, Sr. | 84/415 |
| 4,138,920 | 2/1979 | Meador | 84/415 |
| 4,510,837 | 4/1985 | Keller | 84/184 |
| 4,787,286 | 11/1988 | Okumura | 84/417 |
| 5,844,157 | 12/1998 | Kasha | 84/415 |

FOREIGN PATENT DOCUMENTS

| | | |
|---|---|---|
| 525282 | 8/1940 | United Kingdom . |
| 1106854 | 3/1968 | United Kingdom . |

*Primary Examiner*—Robert E. Nappi
*Assistant Examiner*—Kim Lockett
*Attorney, Agent, or Firm*—Moore & Hansen

[57] ABSTRACT

An adjustable camber induced snare assembly for a drum with a hollow body with a batter head and a snare head comprises an elongate snare a support fastenable adjacent to the hollow body extending across the snare head. Opposing adjustable and biased snare fasteners are mountable on the snare support for slightly tensioning and supporting snares. Adjusting the snare fasteners creates a camber in the snares to adjustably urge the snares to continuously have contact with the snare head during drum play without significant tensioning.

33 Claims, 6 Drawing Sheets

CAMBER INDUCED SNARE ADJUSTER

BACKGROUND OF THE INVENTION

This invention relates to musical drums and more particularly to an adjustable camber induced snare assembly for a snare drum.

Snare drums are different from all other drums which generally consist of a hollow body or shell with a striking or batter head and a lower head. Snare drums utilize snares held against the outside of the lower head. Snares were originally made of gut. Beginning in the 1900's, snares were being made of small would wires or metal helices. The snares nowadays are made even harder and brittle by chrome plating or heat treating to harden. Up until the 1960's,. the drum head were generally made of animal skin. However, these heads were sensitive to humidity and temperature. Thus, drum head since the 1960's have generally been composed of polyester film commonly referred to as MYLAR®. The combination of the polyester film and chrome plated metal snares creates a bright, colorful tone from the snare drum that is sharply defined and crisp.

Snares are often held against the lower drum head or snare head by a snare strainer. The snare strainer performs two basic functions. When you "throw on" or pull up the snares against the head, you are also pulling the snares from a "loose" state to a "tensioned" state across and in contact with the lower head. These two basic functions of tension and head contact relate to drum sensitivity and playing volume.

For snares to vibrate against a softly played drum, they need to be at a loose tension. If the tension is too tight, the drum will "choke" and produce an uncharacteristic or undesirable sound. If the drum is to be struck hard, there is a tendency for the loosely tensioned snares to fly away from the lower head creating dead spots.

DESCRIPTION OF THE RELATED ART

Before a detailed description of the present invention is made, an explanation in detail of the snare drum art, operational problems and attempted solutions will be most helpful.

Referring to FIGS. 1 through 6, a prior art snare drum 10 may be seen to comprise of a hollow body or shall 12. On the top of the hollow body is batter head 14 which is subject to being struck by perhaps drum stocks. Snare head 16 is opposite the batter head 14. Heads 14 and 16 are suitably held in place by hoops as it known.

The snare bed 18 is formed by way of cut out portions in the hollow body 12. As the snare head 16 is held by hoops to the hollow body 12, indented snare beds 18 create an inward bow 20 in the snare head 16. Ribbons 24 connect to the fastening means or strainers 22 and the terminal plates 26. Terminal plates 26 support multiple snare 28 made of wire helices which may be chrome plated steel.

In operation, the terminal plates 26 and ribbons 24 are positioned in the snare body 18 regions and affixed to the fastening means or a strainer 22 to place the snares 28 in contact with the snare head 16 shown in FIG. 2. In operation, FIG. 6 shows the resting state R of the snares 28 substantially in contact with the snare head 16. Typically, a three to five pound tension is placed on the snares 28 as they stretch across the snare head 16.

As the batter head 14 is struck by a drum stick, the snare had 16 and snares 18 move downwardly, as much as one-half inch at its point of greatest amplitude, from their resting position R shown in series from FIG. 6 to FIG. 7. As the snare head 16 rebounds upwardly in FIG. 8, the snares 28 lag behind. When the snares 18 lose contact with the snare had 16, inconsistencies in the drum's sound occur as previously discussed.

Referring to FIGS. 9 and 10, the Gariepy U.S. Pat. No. 4,018,130 reveals a snare assembly 30 that was designed in an attempt to keep the snares 36 in contact with the snare head 16. The mounting frame 32 fixedly tensions and supports the terminal plates 34 in the snare bed. The terminal plates 34 are slightly included to bow the snares 36 upwardly. However, tensioning of snare 36 under normal tensions of three to five pounds by placement of the terminal plates 34 into the frame 32 resulted in loss of the arc or bowing of the snares. Therefore, the sound problems previously discussed occur.

Referring to FIGS. 11 and 12, Thompson's U.S. Pat. No. 3,113,481 discloses snare assembly 40 which also attempted to correct problems by doing away with the snare bed. The mounting frame42 had tightenable bridge 44 by way of screw 46 which fits in the frame and which permitted the tensioning of snares 47. This assembly was similarly fastened by ribbons 48. Nonetheless, the snares 47 did not always consistently follow the snare head 16 and was little improvement over Bower's snare attachment in U.S. Pat. No. 1,236,667.

Thus, the snare bed 18, which created a bow 20 in the snare head 16, has been the oldest and widely used tool in increasing snare 28 contact. However, problems with the snares 28 continuously following the snare head 16 during heavy playing still exists along with the problem of getting more snare 28 contact on the bottom head 16. This means that even if one strand is a bit out or away from the snare head, excessive buzzing can occur. This problem may occur if the snares are mishandled or accidentally bent. Also, the snares 18 are impossible to repair due to their extreme hardened nature. Thus, the result is buzzing. Further tensioning of the snares will only "choke" the drum by further preventing the snares 28 to vibrate.

Problems, such as choking, buzzing and dead spots, happen when the snares do not fully contact the snare head or the snares have become bent by mishandling or accident. Drummers have attempted to eliminate buzzing, dead spots and unwanted sound by pulling the snares more tightly against the bottom of the drum head with a tension of three to five pounds or greater. This works to a degree but has a tendency to "choke" the drum.

There is a need for a snare assembly that will support the snares for ideal sound during soft or hard drum play but will not require significant tensioning to keep the snares in continuous contact with the snare head.

SUMMARY OF THE INVENTION

An adjustable camber induced snare assembly for a drum with a hollow body with a batter head and a snare head comprises an elongate snare support fastenable adjacent to the hollow body extending across the snare head. Opposing, adjustable and biased snare fasteners are mountable on the snare support for slightly tensioning and supporting snares. Adjusting the snare fasteners creates a camber in the snares to adjustably urge the snares to continuously have contact with the snare head during drum play without significant tensioning.

A principal and advantage of the present invention is that the snare assembly creates a camber in the snares to continuously contact the snare head during drum play with only minor tensioning in the range of one ounce. This amount of tensioning has nothing to do with the response of the snares other than keeping the snares in alignment or parallel in an orderly fashion.

Another object and advantage of the present invention is that the drum will not choke or buzz with the present snare assembly in that the snares are always in contact with the snare head with slight tension to create the truest and clearest sharp, colorful, uplifting sound.

Another object and advantage of the present invention is that both the tension and the upward camber in the snares are readily adjustable.

Another object and advantage of the present invention is that the snares with their cambered contact with the snare head do not fly away from the snare head during harder play but rather follow it both outwardly and inwardly on rebound maintaining contact with a loose tension.

Another object and advantage of the present adjustable camber induced snare assembly is that it allows for greater control of the sensitivity and sound production of the snare drum.

Another object and advantage of the present snare assembly is that it is adaptable and usable with any snare drum and also eliminates the need for a snare bed which is a costly production feature of snare drums.

Another object and advantage of the present invention is that the snare assembly will readily work with any drum with or without a snare bed.

BRIEF DESCRIPTION OF THE DRAWINGS

FIG. 16 is a perspective view of the present invention in a cambered and lightly tensioned state ready for play;

FIG. 22 is a partially broken away side elevational view of a snare drum with the present invention positioned inside the hollow body or drum shell on top of the snare head.

DETAILED DESCRIPTION

Figure 1:
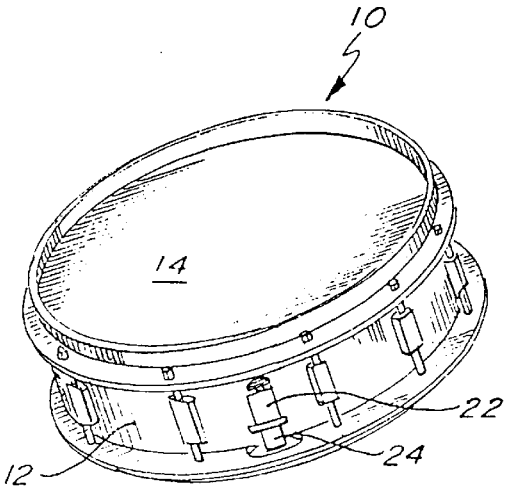
Fig. 1. PRIOR ART
FIG. 1 is a prior art perspective view of a snare drum.
Figure 2:
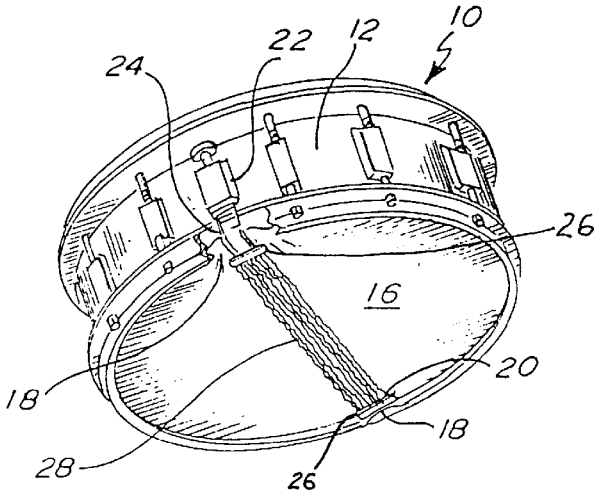
Fig. 2. PRIOR ART
FIG. 2 is bottom perspective view of a prior art snare drum.
Figure 6:
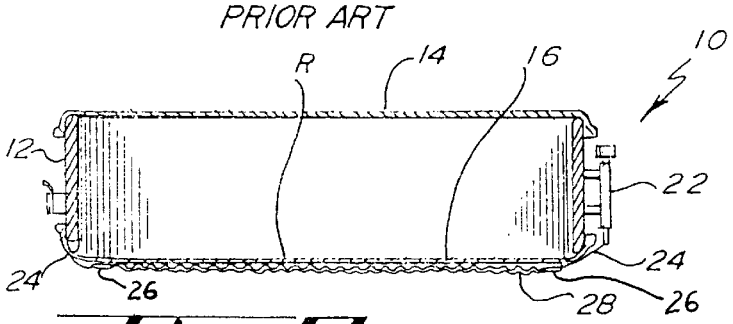
Fig. 6. PRIOR ART
FIG. 6 is a cross-sectional view of the snare drum with snares and strainer similar to FIG. 5 and in a resting state.
Figure 7:
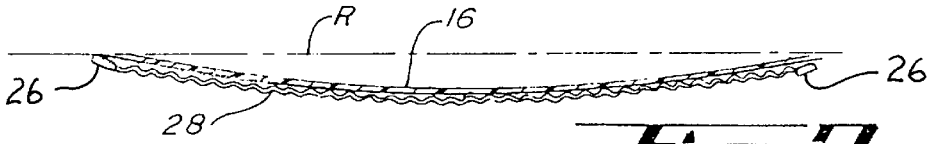
Fig. 7. PRIOR ART
FIG. 7 is a side elevational view of a prior art snare head and snares after being struck by a drum stick in series from the resting state of FIG. 6.
Figure 8:
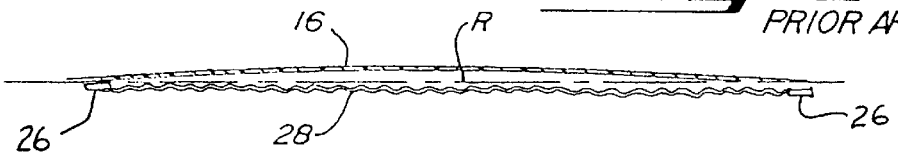
Fig. 8. PRIOR ART
FIG. 8 is a side elevational view of the snare head and snares on the rebound in series with FIGS. 6 and 7.
Figure 5:
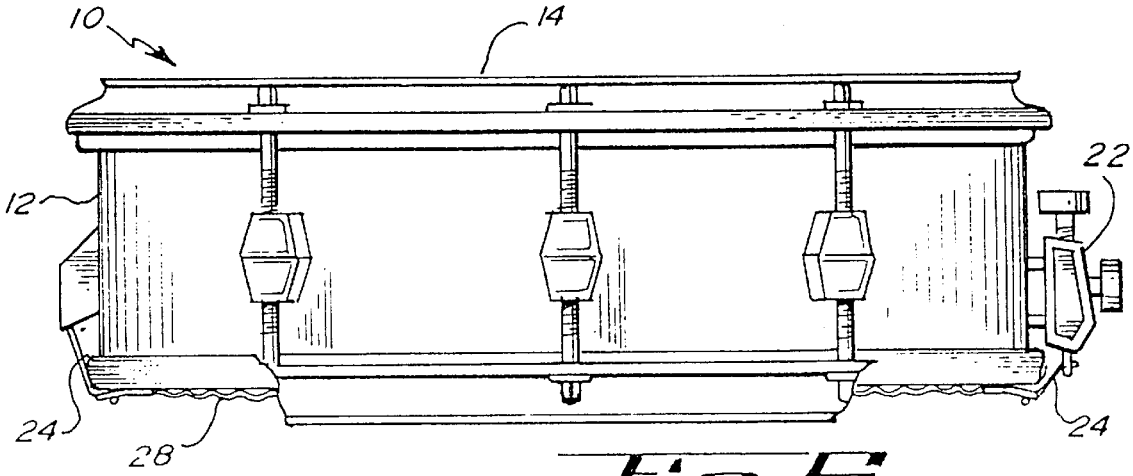
Fig. 5. PRIOR ART
FIG. 5 is a prior art side elevational view of a snare drum partially broken away showing the snares affixed in place against the snare head by a strainer.
Figure 3:
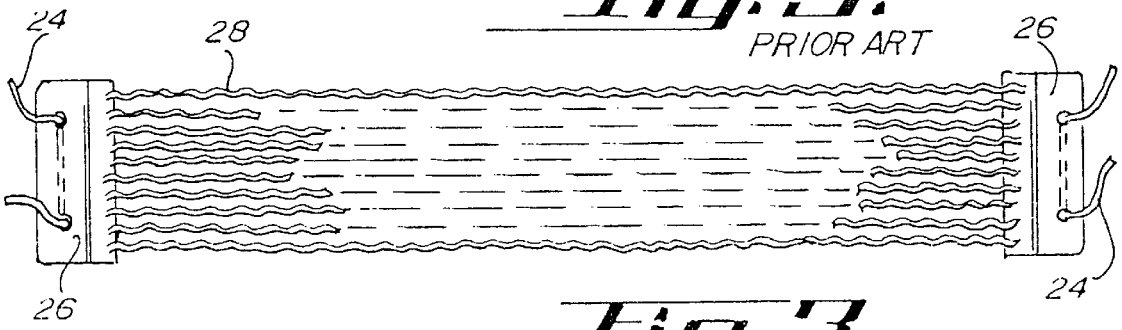
Fig. 3. PRIOR ART
FIG. 3 is prior art top plan view of snares supported by terminal plates with connecting ribbons.
Figure 4:
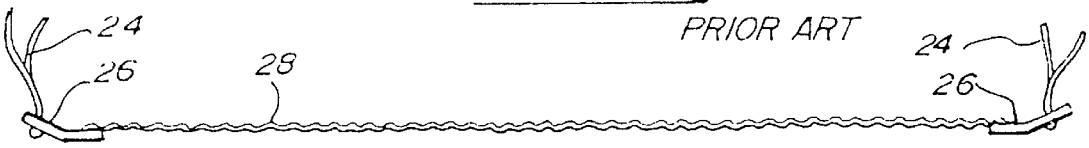
Fig. 4. PRIOR ART
FIG. 4 is a side elevational view of the prior art snares of FIG. 3.
Figure 9:
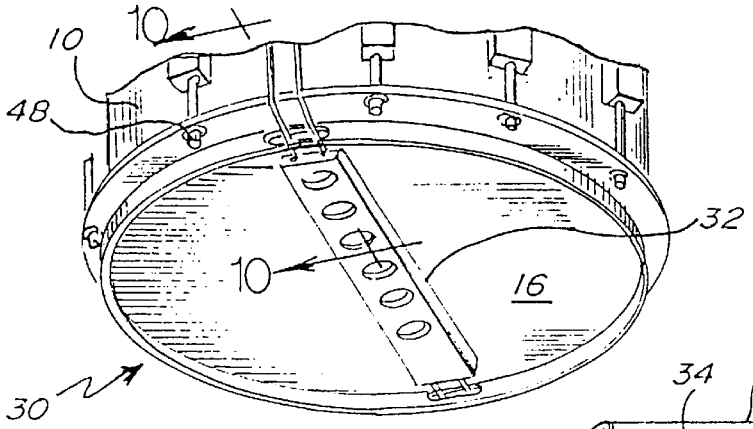
Fig. 9. PRIOR ART
FIG. 9 is a partially broken away snare drum with the Gariepy >130 snare assembly thereon.
Figure 10:
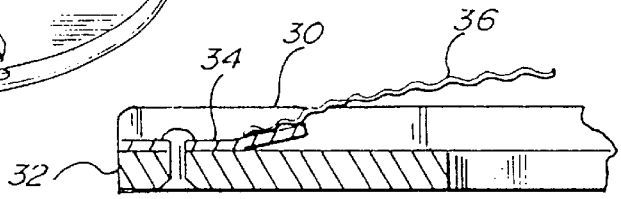
Fig. 10. PRIOR ART
FIG. 10 is a cross-sectional view taken along lines 10—10 of FIG. 9.
Figure 11:
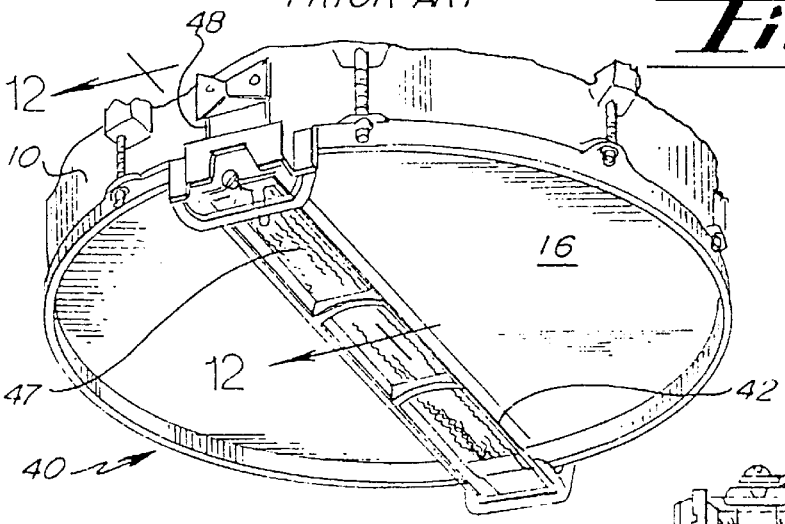
Fig. 11. PRIOR ART
FIG. 11 is a partially broken away view of a snare drum with the Thompson >481 prior art snare assembly affixed thereto.
Figure 12:
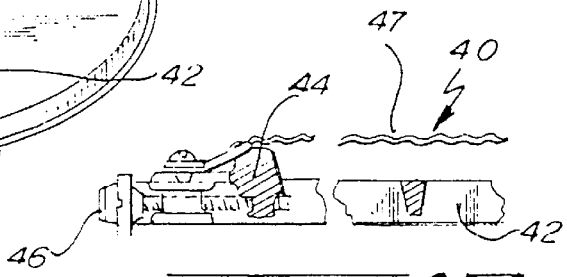
Fig. 12. PRIOR ART
FIG. 12 is a cross-sectional view taken along lines 12—12 of FIG. 11.
Figure 15:
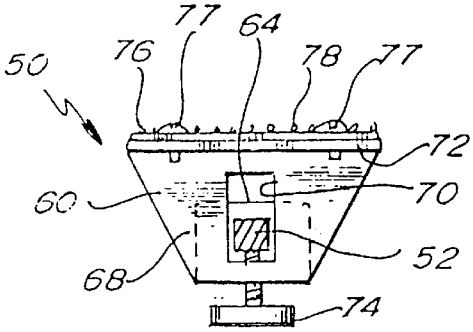
FIG. 15 is a cross-sectional view taken along lines 15—15 of FIG. 14.
Figure 18:
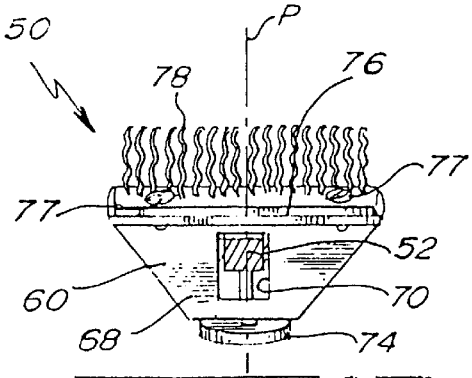
FIG. 18 is a cross-sectional view taken along lines 18—18 of FIG. 17.

The present adjustable camber induced snare assembly 50 generally includes an elongate snare support or rod 52 fastenable to the hollow body or shell 12 of a snare drum 10 by way of assembly brackets 80 or blocks 94 or 94' with ribbons 90 or 102 connected to a strainer mechanism 22. The snare support or rod 52 adjustably supports and biases snare fasteners 60 for slightly tensioning and supporting snares 78 into an adjustable camber condition to urge the snares 78 into continuous contact with the snare head 16 during drum play.

The adjustable camber induced snare assembly 50 of the present invention solves the problems in the related drum art as described above. Referring to FIGS. 13 through 18, the detail of the snare assembly 50 will now be appreciated.

An elongate snare support or rod 52 suitably supports two adjustable spring blocks 54 to be held in place on rod 52 by set screws 56. Distally are placed round springs 58 over the rod 52 after which snare fasteners 60, which are generally U-shaped, are placed about rod 52. The snare fasteners 60 in detail each include a base 62, short leg 64 with a square opening 66, and a tall leg 68 with a vertically oriented longer rectangular opening 70. The rod 52 passes through the openings 66 and 70 of the respective snare fasteners 60 to make the fasteners 60 slidable upon the rod 52. Atop of tall leg 68 is terminal plate support 72. An adjustment screw 74 is eccentrically placed through each base 62 as to bear on the rod 52 to permit the pivoting of the snare fasteners 60. As can be seen between FIGS. 14 and 17, as the snare fasteners 60 are pivoted, the short legs 64 bear upon springs 58 and rotate or move inward as the arc or camber is formed. This prevents further tensioning of the snares 78 while forming the camber. The terminal plates 76 of the snare 78 are secured by screws 77 to the terminal plate supports 72 of the fastener 60.

Figure 13:
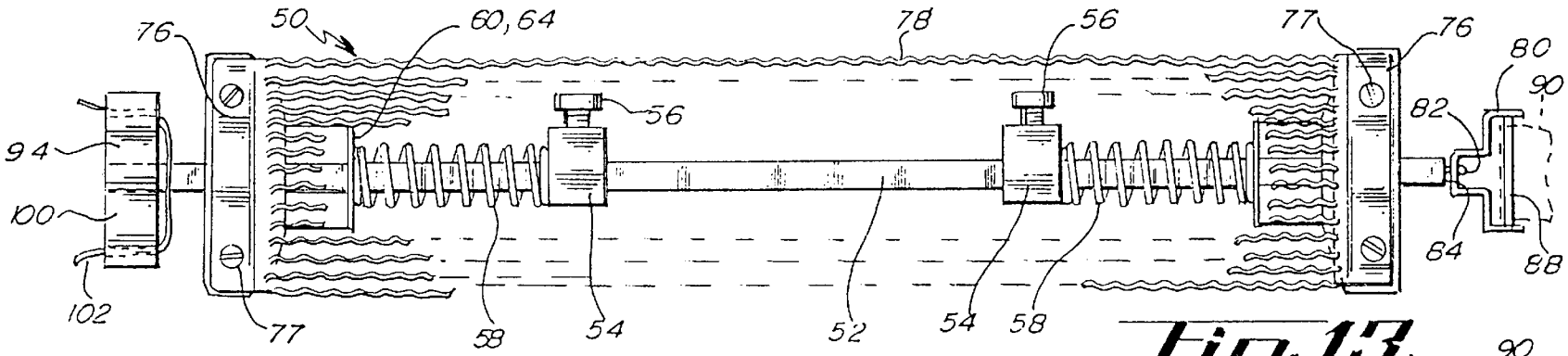
FIG. 13 is a top plan view of the adjustable camber induced snare assembly of the present invention.
Figure 14:
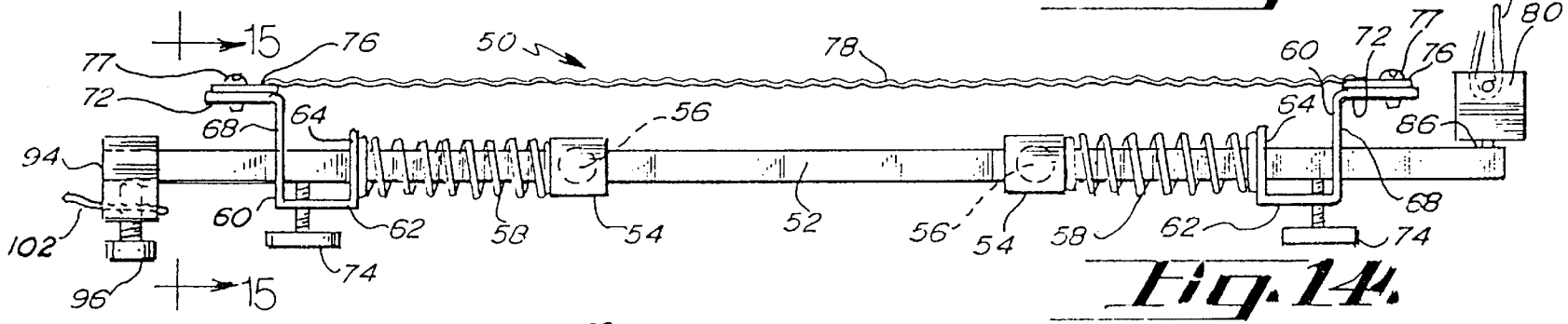
FIG. 14 is a side elevational view of the present invention.

The snare assembly 50 may be fastened to the drum 10 by several methods. FIGS. 13 and 14 show assembly brackets 80 secured either to the rod end 84 or the top side 86 adjacent the end 84. A pin 88 will secure ribbon 90 which may be fastened to the conventional strainer 22 shown in the earlier figures. Alternatively, assembly blocks 94 or 94' shown in FIGS. 13,14 and 17 may be used. Block 94 simply has ribbon apertures passing therethrough after which the ribbons 90 may be secured to the strainer assembly 22. Assembly block 94 is secured onto rod 52 by a set screw 96 given that block94 has an aperture to receive rod 96 therethrough for mounting. Assembly block 94' has a similar set screw 96 arrangement for securement to the rod 52. However, ribbons 102 are secured thereto by a friction fit between ribbon plate 98 and block 94' by machine screws 100.

Figure 17:
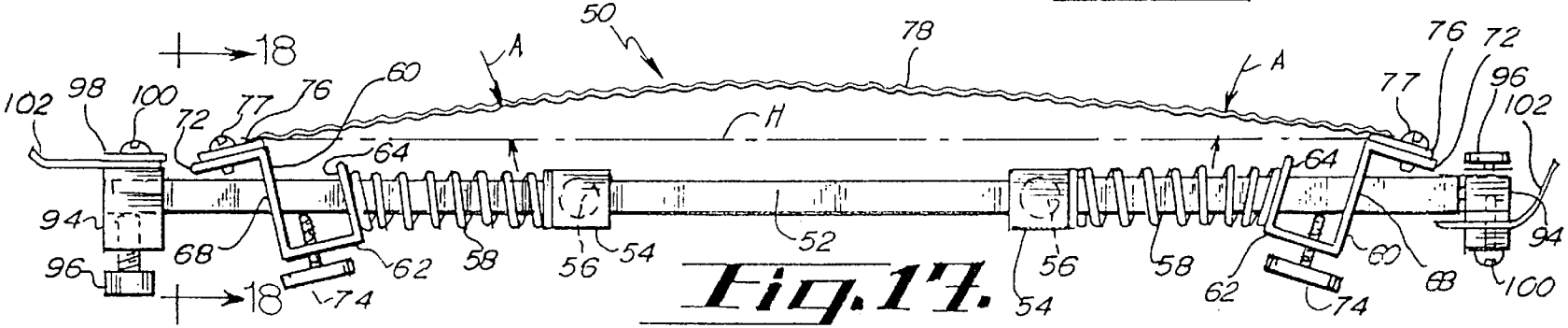
FIG. 17 is a side elevational view of the present invention in a ready state similar to FIG. 16.
Figure 1B:
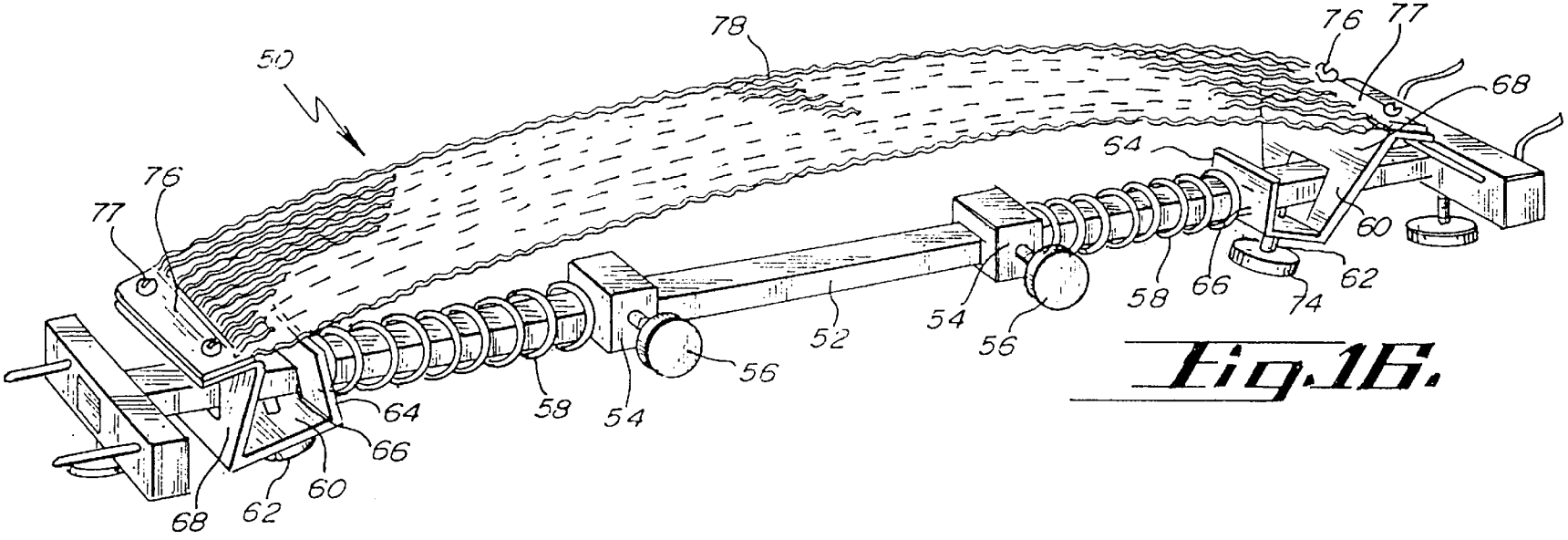
Figure 2B:
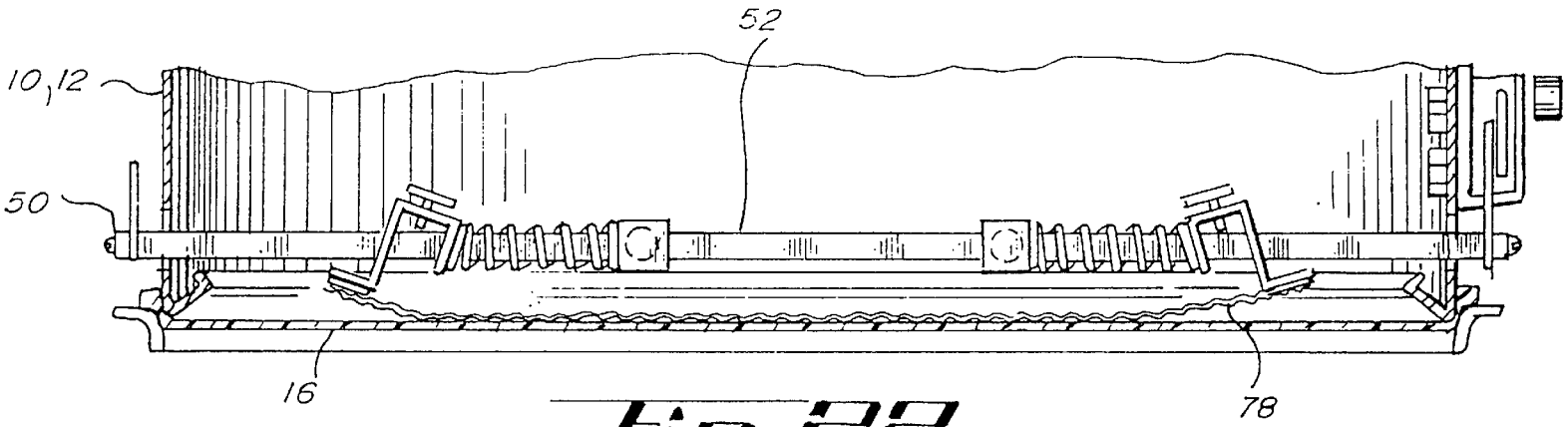

In operation, the snare assembly 50 is to be slightly tensioned and cambered. The adjustable spring blocks 54 are moved outwardly as to create approximately one ounce or just enough tension on the snares 78 to keep the individual snares 78 in alignment after which the set screws 56 are secured. Next, the snare fasteners 60 have their adjustment screw 74 turned to place a camber in the snares 78. The heel portions of short legs 74 urge inwardly against spring 58 on both ends of the snare assembly to compensate for and to not allow an increase of the tension upon the snares 78. The camber or arcing of snare fasteners 60 are shown in FIG. 17 as arcs A and A' in relation to H or horizontal. These arcs A and A' are in plane P which is parallel to support rod 52 shown in FIG. 18.

Figure 19:
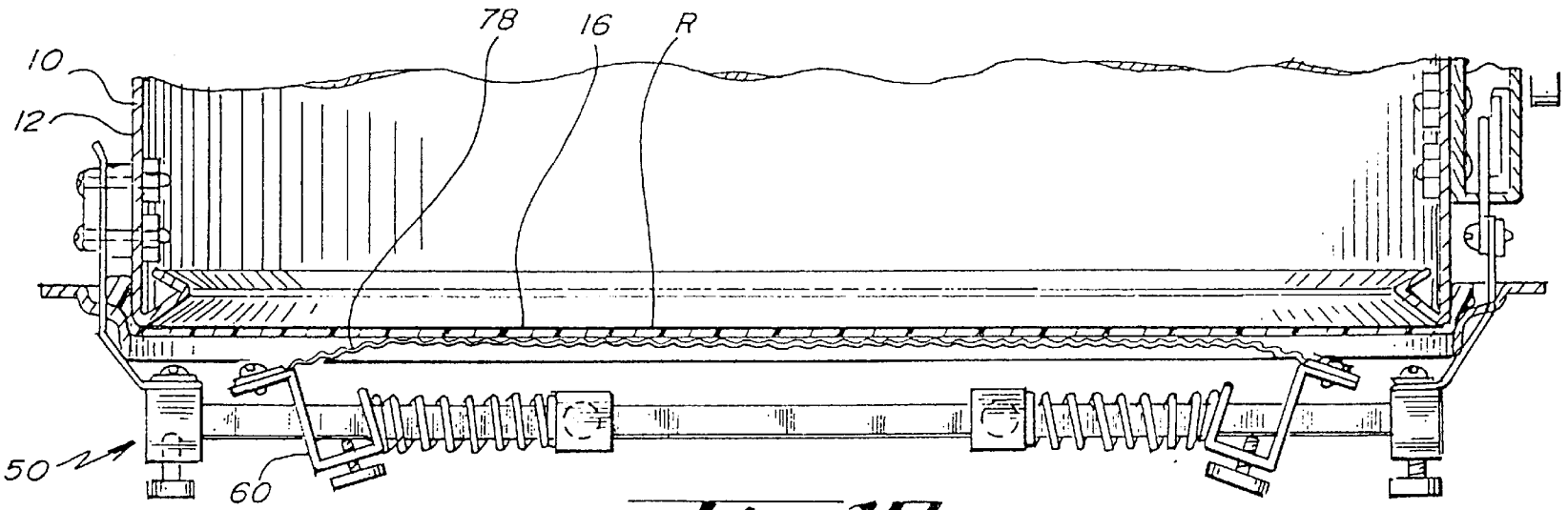
FIG. 19 is an operational cross-sectional view of the present invention mounted on a snare drum ready for play in its rest state.
Figure 20:
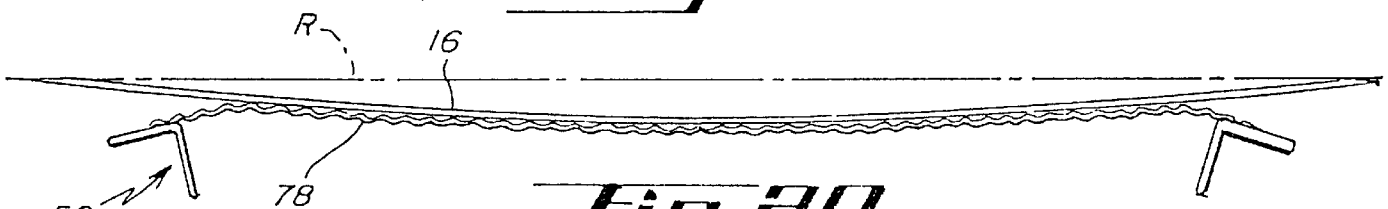
FIG. 20 is a schematic operational view of the snare head and snares after the batter head has been struck in series from the resting state of FIG. 19.
Figure 21:
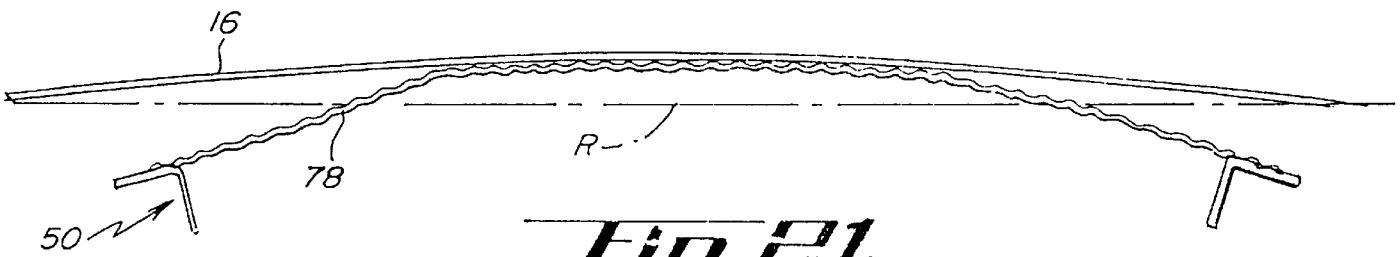
FIG. 21 is a schematic operational view in series with FIGS. 19 and 20 showing the snares following the snare head on rebound.

Referring to FIGS. 19, 20 and 21, the continuous contact of the snares 78 with a snare head 16 will be appreciated and understood. As the batter head is struck by perhaps a drum stick, the snare head 16 and snares 78 of the present invention move downwardly together from FIGS. 19 to 20 from their resting state R. As the snare head 16 rebounds upwardly in FIG. 21, the snares 78 continuously follow and remain in contact due to the camber adjusted into the snares 78 by the snare assembly 50 as described. Thus, the truest, clearest and most accurate snare sound may be achieved without choking, distortion or buzzing.

Referring to FIG. 22, the snare assembly 50 of the present invention may be placed within the hollow body or shell 12 of the snare drum 10 just above the snare head 16 and suitably mounted therein as passing through the shell 12 and secured thereat by strainer-like mechanisms. The operation of this snare assembly 50 within the drum 10 is the same.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the

What is claimed:

1. An adjustable camber induced snare assembly for a drum with a hollow body with a snare head, the assembly comprising:

a) an elongate snare support fastenable adjacent to the hollow body extending across the snare head; and b) opposing snare fasteners longitudinally slidable on the snare support for slightly tensioning and supporting snares wherein one of the snare fasteners is rotatable upon the snare support to create a camber in the snares to urge the snares to continuously have contact with the snare head during drum play.

2. The assembly of claim 1, wherein the one snare fastener is adjustable in an arc parallel with the snare support.

3. The assembly of claim 1 wherein the snare support is a rod.

4. The assembly of claim 1 wherein the snare fasteners are adjustably biased apart to slightly tension and support the snares.

5. The assembly of claim 1, wherein both snare fasteners are adjustable in arcs parallel with the snare support to create an adjustable camber in the snares.

6. The assembly of claim 1, wherein the snare fasteners are slidable on the snare support, adjustably biased apart to slightly tension and support the snares, and both fasteners being adjustable in arcs parallel with the snare support to create an adjustable camber in the snares.

7. The assembly of claim 1, wherein the snare fasteners are U-shaped with a base, a short leg and a tall leg for supporting the snares, the snare support comprising a rod passing throughout the legs of the fasteners to slidably mount the fasteners thereon.

8. The assembly of claim 7, wherein the fasteners are biased apart by adjustable springs about the rod urging outwardly against one of the legs of each fastener.

9. The assembly of claim 8 further comprising for each fastener a camber adjustment screw passing eccentrically through the base to bear on the rod to adjustably pivot the fastener in an arc defining a plane that is parallel with the rod and against the spring to create an adjustable camber in the snares.

10. An adjustable camber induced snare assembly for a drum with a hollow body with a batter head and a snare head, the assembly comprising:

a) an elongate snare support fastenable adjacent to the hollow body extending across the snare head; and b) opposing snare fasteners mountable on the snare support for slightly tensioning and supporting snares wherein one of the snare fasteners is slidably biased away from the other fastener and one of the snare fasteners is adjustable in an arc parallel with the snare support to create a camber in the snares to adjustably urge the snares to continuously have contact with the snare head during drum play.

11. The assembly of claim 10 wherein the snare support is a rod.

12. The assembly of claim 10 wherein the snare fasteners are slidable on the snare support and are adjustably biased apart to slightly tension and support the snares.

13. The assembly of claim 10, wherein both snare fasteners are adjustable in arcs parallel with the snare support to create an adjustable camber in the snares.

14. The assembly of claim 10, wherein both of the snare fasteners are slidable on the snare support, adjustably biased apart to slightly tension and support the snares, and both fasteners being adjustable in arcs parallel with the snare support to create an adjustable camber in the snares.

15. The assembly of claim 10, wherein the snare fasteners are U-shaped with a base, a short leg and a tall leg for supporting the snares, the snare support comprising a rod passing throughout the legs of the fasteners to slidably mount the fasteners thereon.

16. The assembly of claim 15, wherein the fasteners are biased apart by adjustable springs about the rod urging outwardly against one of the legs of each fastener.

17. The assembly of claim 16 further comprising for each fastener a camber adjustment screw passing eccentrically through the base to bear on the rod to adjustably pivot the fastener in an arc defining a plane that is parallel with the rod and against the spring to create an adjustable camber in the snares.

18. An adjustable camber induced snare assembly for a drum with a hollow body with a batter head and a snare head, the assembly comprising:

a) an elongate snare support rod fastenable adjacent and to the hollow body extending across the snare head; and b) opposing snare fasteners slidably mounted on the snare support rod and are adjustably biased apart for slightly tensioning and supporting snares wherein the snare fasteners are adjustable each in an arc parallel with the snare support rod to create a camber in the snares to adjustably urge the snares to continuously have contact with the snare head during drum play.

19. The assembly of claim 18, wherein the snare fasteners are U-shaped with a base, a short leg and a tall leg for supporting the snares, the snare support passes through the legs of the fasteners to slidably mount the fasteners thereon.

20. The assembly of claim 19, wherein the fasteners are biased apart by adjustable springs about the rod urging outwardly against one of the legs of each fastener.

21. The assembly of claim 20 further comprising for each fastener a camber adjustment screw passing eccentrically through the base to bear on the rod to adjustably pivot the fastener in an arc defining a plane that is parallel with the rod and against the spring to create an adjustable comber in the snares.

22. An adjustable camber induced snare assembly for a drum with a hollow body with a batter head and a snare head, the assembly comprising:

a) an elongate snare support rod fastenable adjacent and to the hollow body extending across the snare head; and b) opposing snare fasteners slidably mounted on the snare support rod and are adjustably biased apart by a spring about the rod urging outwardly against one of the fasteners for slightly tensioning and supporting snares wherein the snare fasteners are pivotally adjustable each in an arc parallel with the snare support rod and against the spring to create a camber in the snares to adjustably urge the snares to continuously have contact with the snare head during drum play.

23. The assembly of claim 22, wherein the snare fasteners are U-shaped with a base, a short leg and a tall leg for supporting the snares, the snare support rod passes through the legs of the fasteners to slidably mount the fasteners thereon.

24. An adjustable camber induced snare assembly for a drum having a hollow body with a head, the snare assembly comprising:

a) an elongate snare support fastenable to said hollow body of said drum adjacent to and extending across said head; and b) a pair of opposing snare fasteners mounted on said snare support for supporting a plurality of snares therebetween wherein one of said snare fasteners is rotatable upon said snare support to create a variable camber in said snares to urge said snares into continuous contact with said head of said drum during drum play.

25. The snare assembly of claim 24 wherein one of said opposing snare fasteners is longitudinally slidable on said snare support.

26. The snare assembly of claim 24, wherein said one snare fastener is rotatable in an arc parallel with the snare support.

27. The snare assembly of claim 24 wherein said snare support is a rod.

28. The snare assembly of claim 25 wherein the snare fasteners are resiliently biased apart to tension and support the snares.

29. The snare assembly of claim 24, wherein the snare fasteners are U-shaped comprising a short leg and a tall leg interconnected by a base, the tall leg being arranged and constructed to mount thereto one of the respective ends of each of the plurality of snares and wherein the snare support comprises a rod passed through each of the respective legs of the fasteners.

30. The snare assembly of claim 29, wherein the snare fasteners are resiliently biased apart by at least one spring mounted on the rod which urges at least one of said snare fasteners away from said remaining snare fastener.

31. The snare assembly of claim 30 further comprising a camber adjustment screw received through the base of one snare fastener so as to bear on the rod, the adjustment screw being located such that by extending or retracting the adjustment screw, said one snare fastener will be caused to pivot in an arc parallel with the rod and against the spring to create a camber in the snares.

32. The snare assembly of claim 28 wherein the snares are placed under less than 8 ounces of longitudinal tension.

33. The snare assembly of claim 28 wherein the snares are placed under less than 1 ounce of longitudinal tension.

* * * * *